US009523532B2

(12) United States Patent
Delgadillo

(10) Patent No.: US 9,523,532 B2
(45) Date of Patent: Dec. 20, 2016

(54) GLYCOL PAN CHILLER SYSTEMS WITH INTEGRATED STOVE TOP

(71) Applicant: Hector Delgadillo, Duarte, CA (US)

(72) Inventor: Hector Delgadillo, Duarte, CA (US)

( * ) Notice: Subject to any disclaimer, the term of this patent is extended or adjusted under 35 U.S.C. 154(b) by 0 days.

(21) Appl. No.: 14/635,245

(22) Filed: Mar. 2, 2015

(65) Prior Publication Data

US 2015/0173526 A1 Jun. 25, 2015

Related U.S. Application Data

(63) Continuation-in-part of application No. 13/970,041, filed on Aug. 19, 2013.

(60) Provisional application No. 61/766,504, filed on Feb. 19, 2013.

(51) Int. Cl.

| | |
|---|---|
| ***F25D 17/02*** | (2006.01) |
| ***F25D 23/06*** | (2006.01) |
| ***F25D 11/00*** | (2006.01) |
| ***F25D 31/00*** | (2006.01) |
| *A47F 3/04* | (2006.01) |
| *A47F 10/06* | (2006.01) |

(52) U.S. Cl.

CPC ..... *F25D 23/061* (2013.01); *F25D 11/00* (2013.01); *F25D 31/00* (2013.01); *A47F 3/0486* (2013.01); *A47F 10/06* (2013.01); *F25D 17/02* (2013.01)

(58) Field of Classification Search

CPC ..... F25D 23/061; F25D 31/003; F25D 11/00; F25D 17/02

USPC ..... 62/99, 451, 185; 165/104.14; 99/517

See application file for complete search history.

(56) References Cited

U.S. PATENT DOCUMENTS

| | | | | |
|---|---|---|---|---|
| 2,637,530 | A * | 5/1953 | Janos | 165/136 |
| 5,117,649 | A * | 6/1992 | Mangini et al. | 62/251 |
| 5,181,395 | A | 1/1993 | Carpenter et al. | |
| 5,355,687 | A | 10/1994 | Carpenter et al. | |
| 5,678,421 | A * | 10/1997 | Maynard et al. | 62/407 |
| 5,927,092 | A | 7/1999 | Kushen et al. | |
| 6,145,333 | A * | 11/2000 | Richmond et al. | 62/258 |
| 7,069,732 | B2 * | 7/2006 | Walker et al. | 62/99 |
| 8,250,881 | B1 * | 8/2012 | Reihl | 62/451 |
| 2006/0201177 | A1 | 9/2006 | Spillner | |
| 2006/0230948 | A1 | 10/2006 | Matus | |
| 2009/0013707 | A1 | 1/2009 | Spillner | |
| 2011/0072849 | A1 * | 3/2011 | Kuehl et al. | 62/498 |

* cited by examiner

*Primary Examiner* — Ryan J Walters
*Assistant Examiner* — Joseph Trpisovsky
(74) *Attorney, Agent, or Firm* — Steven A. Nielsen; www.NielsenPatents.com

(57) ABSTRACT

A glycol pan chiller is combined with a gas range system to allow for convenient cooking and chilled food storage. A disclosed glycol pan chiller system comprises a first food cooling area 110 cooled by glycol contained within a glycol void area 130, the void area defined within an inner liner 160. Under normal conditions, the glycol will remain stationary within the inner liner and will be chilled by a Freon line 140 contained within the glycol void area. A second food cooling area is cooled by use of glycol or other fluid contained within the glycol void area. The second food cooling area does not require the use of a separate Freon cooling system.

10 Claims, 21 Drawing Sheets

GLYCOL PAN CHILLER SYSTEMS WITH INTEGRATED STOVE TOP

CROSS-REFERENCE TO RELATED APPLICATIONS

This is a utility application is a continuation in part or CIP of U.S. patent application Ser. No. 13/970,041 filed on or about Aug. 19, 2013 which is based upon and claims the benefit of U.S. patent application Ser. No. 61/766,504, entitled "Glycol Pan Chiller Systems" filed on Feb. 12, 2013. These related applications are incorporated herein by reference and made a part of this application. If any conflict arises between the disclosure of the invention in this utility application and that in the related applications, the disclosure in this utility application shall govern. Moreover, the inventors incorporate herein by reference any and all patents, patent applications, and other documents hard copy or electronic, cited or referred to in this application.

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever. Such trademark(s) may include, Turbo Coil.

BACKGROUND OF THE INVENTION (1) Field of the Invention

The invention generally relates to refrigeration and heating systems. More particularly, the invention relates to means and methods of producing and using glycol pan chiller systems in multi-cooling compartment systems.

(2) Description of the Related Art

The use of glycol in cooling systems is known in general, but the prior art fails to teach, suggest or motivate one skilled in the art to construct the disclosed embodiments.

Several systems by KAIRAK are known in the art. For example U.S. Pat. No. 5,181,395 "Condenser Assembly", U.S. Pat. No. 5,927,092 "Food Pan Refrigeration Unit" and U.S. Pat. No. 5,355,687 "Pan Cooler and Method" disclose various refrigeration systems. While the known KAIRAK patents disclose various physical configurations of assembling cooling systems the KAIRAK patents fail to address the shortfalls in the art. The KAIRAK compressor and pump are almost always in operation. The KAIRAK system contemplates a traditional single food compartment system.

The known relevant published patent applications teach means and methods of protecting food held in a chiller and blowing cold air over food. Such published patent applications include 20090013707 Air blanketed food preparation table; 20060230948 Food Protector Apparatus that Attaches to a Drop-In Food pan and method and 20060201177 Air Blanketed Food Preparation Table. Thus, the trend in the art is to focus upon the protection of food in a chiller, blowing cold air directly upon food and to remain satisfied with the chilling methods of the prior art.

There are many shortfalls in the prior art. For example, the chillers of the prior art typically use 20 year old technology and fail to artfully integrate the use of both glycol and Freon systems. Chillers in the prior art fail to efficiently and economically cool chill pans and related assemblies. For example, chillers of the prior art often use non removable foam material to encase Freon lines wrapping a chiller. When a Freon line leaks, the unit is not economically repairable. The prior art is prone to condensation problems as well. The prior art is prone to blow cold air directly upon food, causing condensation problems and problems with drying out food. The prior art also fails to leverage chilled fluid, such as glycol to cool multiple compartments.

BRIEF SUMMARY OF THE INVENTION

The present invention overcomes shortfalls in the related art by presenting an unobvious and unique combination and configuration of liners, liner installation systems, use of Freon lines, use of glycol flowing in contact with Freon lines, with the glycol in a static state or moving state, with Freon lines chilling glycol within a main cooling compartment and with cool glycol drawn to a second compartment to cool the second compartment by use of a Turbo Coil system or other evaporation coil system. Shortfalls in the related art are overcome by use of a single compressor and pump to efficiently cool two food chambers. Disclosed embodiments provide self-contained refrigeration systems suitable for preparation tables and other functions.

Disclosed embodiments overcome shortfalls in the art by use of a chiller pan assembly comprising a main or first cooling area, with the first cooling area cooled by an inner liner area, the inner liner area comprised of Freon lines surrounded by free flowing glycol. The Freon lines contain Freon or other fluid cooled by a single or relatively small number of refrigeration condensing and compressor units. The Freon lines wrap around the inner liner area and cool the surrounding glycol or other fluid. The contents of the first or main cooling area or food storage area are cooled indirectly by heat transfer into the Freon lines and surrounding glycol. The Freon lines cool both the main compartment and the surrounding glycol.

A second or ancillary food cooling chamber is efficiently cooled by drawing glycol or other fluid from the inner liner area into the second food chamber. The glycol, cooled solely by the freon lines is transferred, as needed, into a evaporation and coil system located within the second food chamber. The evaporation and coil system blows cool air within the second food chamber and the glycol, is returned, at a slightly higher temperature back into the inner liner area of the first cooling area. The freon lines rechill the glycol.

In disclosed embodiments, new found efficiencies are produced by the artful combination of using indirect cooling in a first food cooling area and air blown cooling in a second cooling area by use of just one condensing and compressor unit. To conserve energy, glycol or other fluid is cooled by use of closed cooling lines filled with Freon or other fluid. The first cooling chamber comprises an interior tank comprising Freon lines and glycol flowing around the freon lines. As no direct air transfer or air blowing occurs within the first food chamber, the glycol stays relatively cold efficiently dissipating cold from the Freon lines. Thus the interior of the first food chamber enjoys a very even distribution of cool temperature, which is ideal for salad bars and various food preparation areas. Such food preparation areas are often in need of direct cool air refrigeration or a second cooling compartment. But, space and energy restrictions do not comport well with a second refrigeration condensing and compressor unit, as used in the prior art. The disclosed embodiments overcome shortfalls in the prior art by using the passively cooled glycol from the main cooling area to remove heat from the second food storage area. The second food storage area may use a Turbo Coil System or evaporation coil and fan system to transfer heat into the glycol with glycol moved from the first cooling area. After use in the second compartment, the heated glycol is returned to the first compartment and evenly rechilled within the inner liner of the first compartment. The heat from the glycol is quickly removed by the volume of remaining glycol within the first cooling compartment system.

The present invention overcomes shortfalls in the art by eschewing the practice of blowing chilled air over food held in a first cooler or cooling area used for quick food access. This solution is known to dry out food. The prior art disclosures also teach methods of blowing cool air to the undersides of a pan chiller or pan container of food. The utility of blowing cool air to the undersides of a chiller is severely limited by the thermal properties of air. In acknowledgement of this shortfall, KAIRAK U.S. Pat. No. 5,927,092 uses cooling fins attached to the chiller in an effort to improve its air cooled system. In the automotive industry, air cooled engines were replaced long ago with liquid cooled engines. But, KAIRAK remains entrenched in the prior art and teaches away from the liquid cooled systems of the present invention.

The present invention overcomes shortfalls in the art by disclosing a new pan system of a first cooling area that is quickly and economically removable from a separate foam installation system. Embodiments of the invention solve problems in the prior art by providing an efficient retro fit system to repair broken cooler pans of the prior art.

The disclosed embodiments have provided unexpected and dramatically favorable results in cooling efficiency by ignoring the air fins and air cooling system of KAIRAK and by using a new inner liner system comprising a Freon line wrapped upon an inner wall of an inner liner. The inner liner is filled with circulating glycol or other coolant fluid which is cooled by the Freon only. When a first or upper food area become too warm, the Freon may be further cooled within an interior liner to further cool the glycol and contents of the first area. When the second or lower food area is too warm, glycol may be drawn down to the second food area to remove heat. In a disclosed embodiment, the second food area is cooled by a Turbo Coil system that circulates cool air within the second compartment. As the second compartment may be filled with covered or wrapped food items, a dry out problem is avoided. The artful combination of Freon lines and a glycol fluid body in contact with both the Freon lines and pan liners satisfies long felt needs in the art with new power and space efficiencies and economic advantages, while efficiently cooling a second area by use of glycol only and wherein the glycol is cooled by the Freon only, vitiating the need for a separate or second refrigeration and condensing and compressor unit.

Disclosed embodiments include a cabinet system wherein a separate refrigeration unit for the Freon is held. Disclosed configurations overcome shortfalls in the prior art wherein pizza flour and other particulates would fowl Freon condensing units.

Disclosed embodiments include a glycol tank wherein glycol is held and cooled in reserve such that cooled glycol is ready for circulation when needed.

Disclosed embodiments include an integrated stove top or burner system to provide a cooking surface near the disclosed refrigeration system.

These and other objects and advantages will be made apparent when considering the following detailed specification when taken in conjunction with the drawings.

REFERENCE NUMERALS IN THE DRAWINGS

Figure 1:
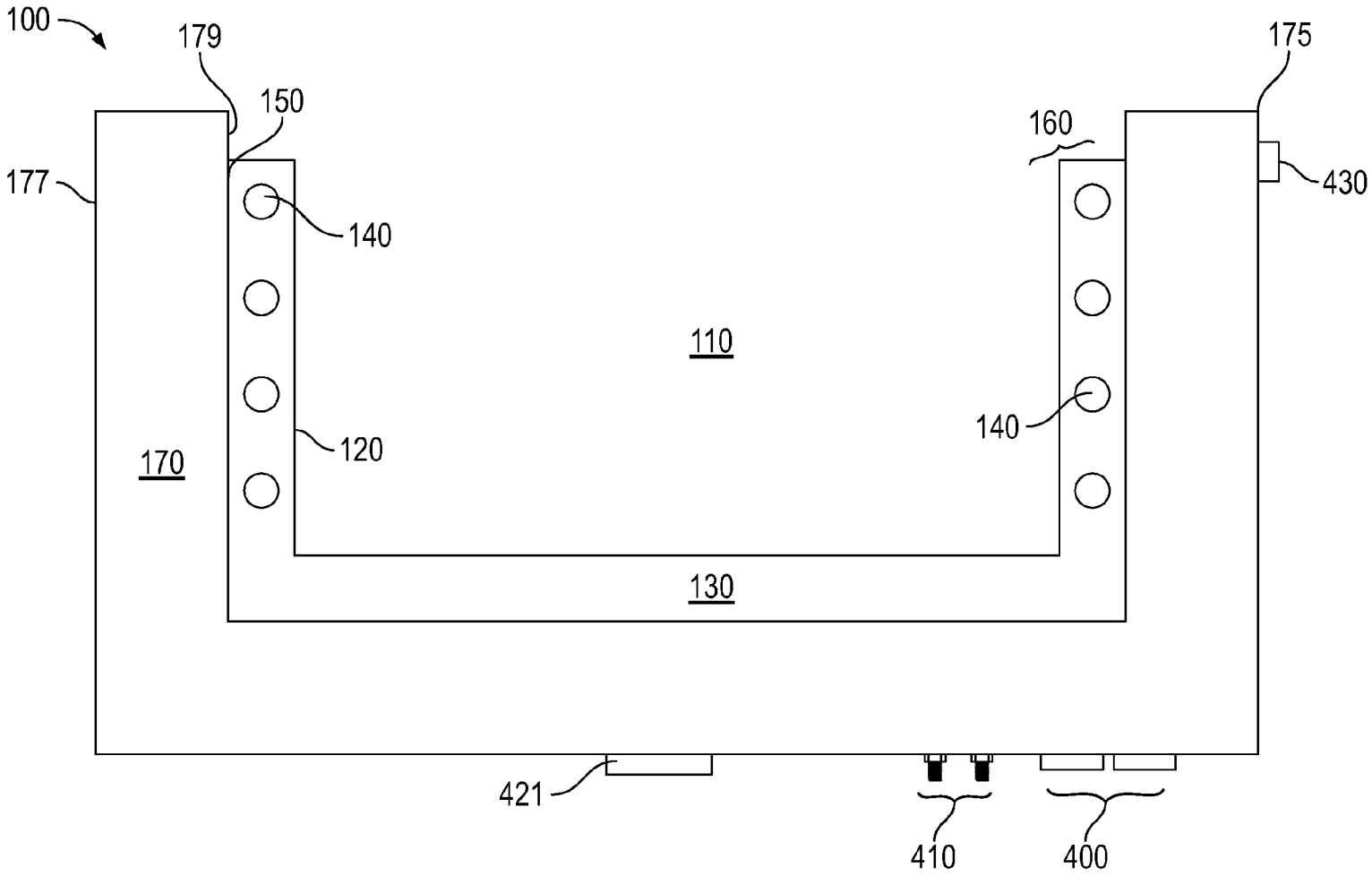
FIG. 1 is a section view of a disclosed liner system

100 pan chiller assembly in general
110 cooling void area within inner liner 160
120 inner wall of inner liner
130 void area within inner liner 160, sometimes called a glycol void area, sometimes filled with glycol and including Freon flow line 140
140 Freon flow line wrapped within inner liner 160
141 a Freon flow line in general
142 Freon inlet to Freon flow line 140
144 Freon outlet of glycol flow line 140
150 outer wall in inner liner
160 inner liner in general
170 insulation area of outer liner sometimes comprised of foam
175 insulation liner in general
177 outer shell of outer liner 175
179 inner wall or inner shell of outer liner 175
200 Turbo Coil System or other evaporation coil and fan system using glycol or other fluid to cool a second food storage area.
210 recirculating pump
215 glycol pipe leading to system 200
220 glycol pipe leading from system 200 to the pan chiller 100 in general or to the void area 130 filled with glycol
242 insulation around the glycol tank 230
225 a glycol flow line in general
230 glycol tank
231 lid to glycol tank 230
232 direction of air flow
233 air filter
234 electrical power supply
235 glycol pump

236 compressor
237 intake for Freon lines within the Freon tank 230
240 Freon lines within the glycol tank 231
242 insulation around the glycol tank 230
250 compressor and condensation compartment
300 generic refrigeration condensing and compressor unit used to cool Freon
310 condenser unit or condenser coil
312 compressor unit
315 DX TXV direct expansion thermal expansion valve
320 liquid line solenoid valve and coil
400 outlet and inlet attachments to Glycol lines and glycol cooling system 200
410 outlet and inlet attachments for connections to and from system 300 used to cool freon
421 attachment area for condensation removal
430 attachment area for connection to glycol
500 a disclosed preparation table
510 a tray shelf or cutting board or food prep area
520 a lid or cover
530 vent door
540 refrigeration door
545 service panel
550 support bar or pan divider
555 raised chamber
560 pans for storing food on upper side of table
565 internal food draws
570 external drawer cover
575 compressor compartment for cooling systems
580 lower refrigerated interior compartment or liner
582 interior shelf within the lower refrigerated interior compartment
584 interior shelf support structure
586 floor of lower interior compartment 580
587 back wall of interior compartment 580
588 ceiling of interior compartment 580
600 digital thermometer measuring temperature of food compartment
700 lower insulation
800 inside glycol tank
805 outside glycol tank
810 liner top
815 liner bottom
820 socket weld tube fitting
825 male to male pipe extension
830 liner side right
835 liner side left
840 drawer track
845 track mount
847 liner mullion
850 exterior channel support
853 exterior top front filler
855 exterior top marine edge
857 drawer face
860 surface for burners
862 exterior bottom
864 digital thermometer
866 louver panel
868 platform
870 pan divider front
872 exterior side
874 exterior side cover
876 top drawer back cover
878 burner assembly
880 burner
881 control knob for gas burner
882 burner grate
884 elevated cooling assembly
886 raised lip section between burners and elevated cooling assembly
888 surface for burner assembly
890 drain of cooling chamber
895 gas line for burners
897 front flat surface used to support the burner assembly
900 compressor system in general
910 inner side panel of compressor compartment
915 exterior side cover of compressor compartment
920 condensation guard
925 louver top rail
927 louver panel
929 fan housing
931 support channel
933 compressor compartment bottom and top channel support bracket
925 compressor compartment platform
937 compressor compartment interior side
940 compressor compartment exterior bottom plate
943 compressor compartment right side
950 front caster for wheel
960 fan
970 digital thermometer
980 compressor
985 fan area, used to blow hot air away from compressor
990 fan housing

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

Referring to FIG. 1, a disclosed pan chiller assembly 100, chiller barrel or liner assembly is shown in a general configuration and may comprise a cooling void area 110 defined within an inner liner 160. The cooling void area 110 may contain food products or pans containing food products. The cooling void area 110 may be referred to as a first or upper cooling area. The first cooling area does not subject food to blown air. Heat transfer may occur within the void area 110 and/or upon or near the inner wall 120 of the inner liner.

The inner liner 160 may comprise an inner wall 120 and an outer wall 150. A glycol void area 130 may be defined within the inner wall 120 and outer wall 150. The glycol void area 130 may contain glycol or other fluid. Freon flow lines 140 may also be disposed within the glycol void area and used to cool the glycol or other fluid. The Freon flow lines 140 may be secured anywhere within the inner liner 160, but are often secured to the inner wall 150 of the inner liner.

The inner liner 160 may be disposed within an insulation liner 175. The insulation liner 175 liner may be removable and may be well suited to retrofit existing systems. The insulation liner 175 may comprise an insulation layer 170 and an outer shell 177 and an inner shell 179 or surface. The inner shell 179 of the insulation layer may rest adjacent to the outer wall 150 of the inner liner 160.

A first set of drain and entry lines 410 or outlet and inlet lines may assist in the optional circulation of Freon while a second set of drain and entry lines 400 may assist in the circulation of glycol. An attachment area 421 may be disposed at the bottom of the insulation liner and used to assist in drainage.

Upper attachment area 430 provides another optional attachment point for the supply of glycol to the glycol void area.

Figure 2:
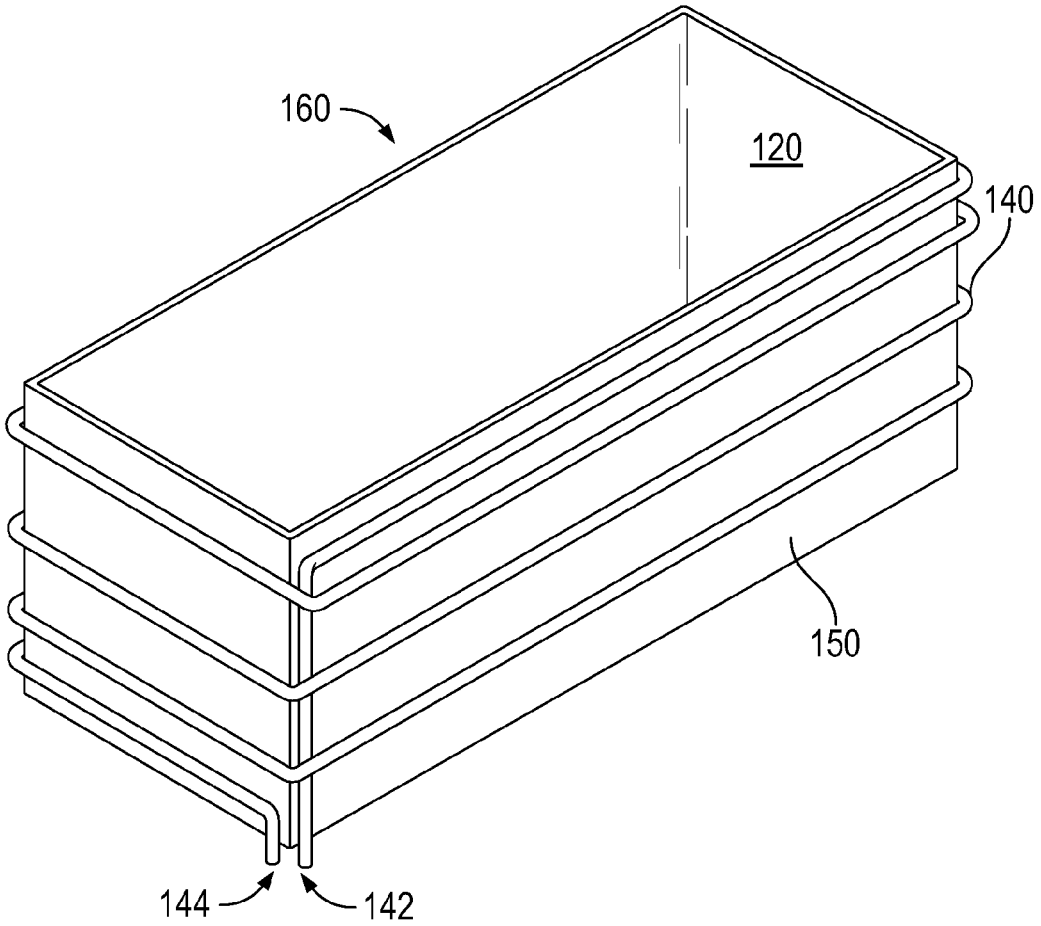
FIG. 2 depicts a perspective view of an inner liner

FIG. 2 depicts a disclosed embodiment wherein an inner liner 160 comprises a tub like structure having an inner wall 120 and an outer wall 150. FIG. 2 depicts the outer wall 150 wrapped with a Freon line 140. The Freon line 140 may be adjacent to or touching the outer wall 150. FIG. 2 further depicts a Freon outlet 144 and a Freon inlet 142. The Freon line 140 may be placed anywhere within the glycol void area.

Figure 3:
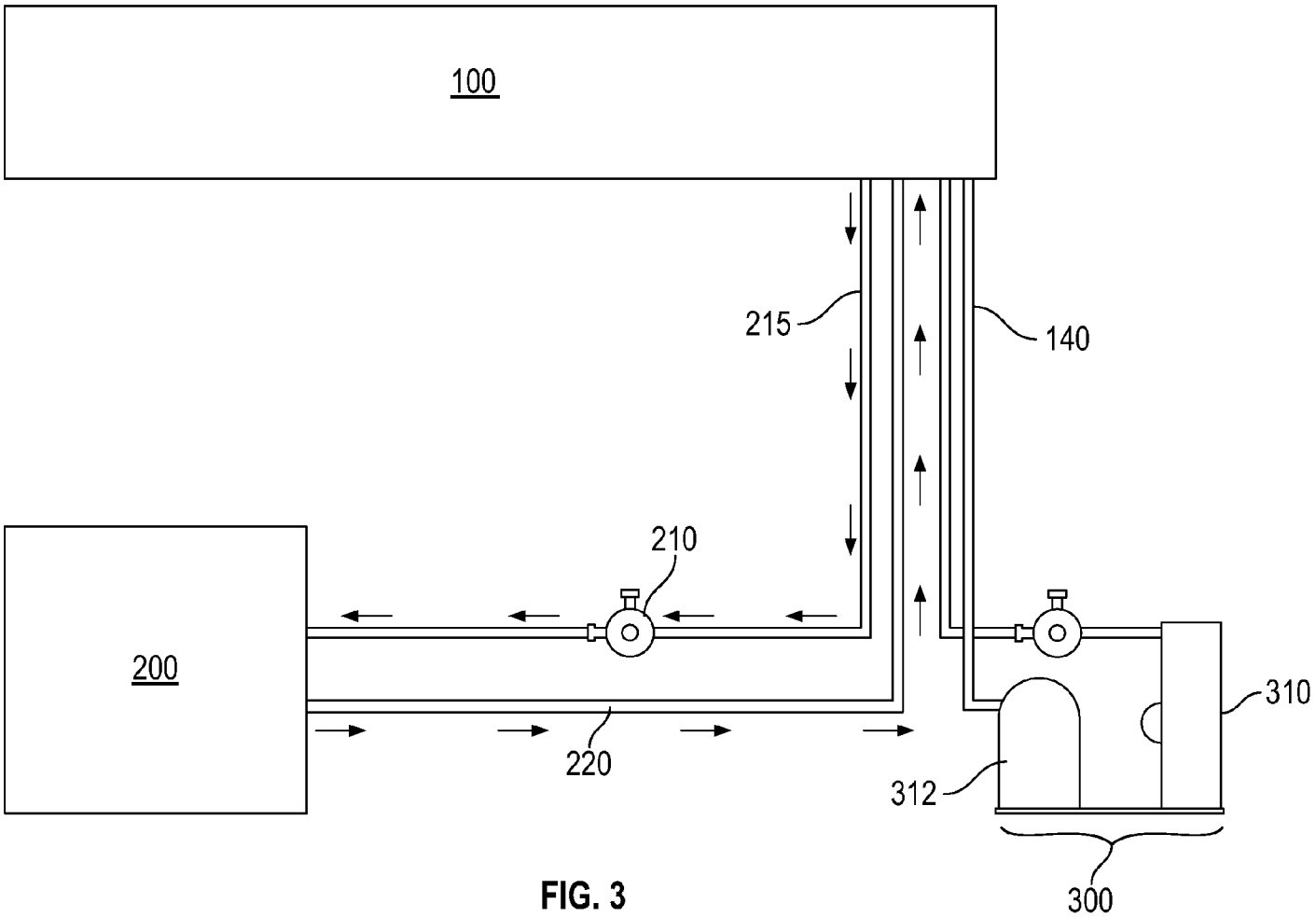
FIG. 3 depicts a disclosed cooling system

FIG. 3 depicts a disclosed system comprising a pan chiller assembly or chiller barrel 100, a Turbo Coil unit or other unit cooler 200 using glycol to cool a second cooling compartment. FIG. 3 shows generally a Freon system used to supply Freon into the Freon lines 140 of FIG. 1.

A refrigeration condensation unit 310 and compression unit 312 are used to assist in cooling the Freon. The condensation unit and compression or compressor unit are sometimes described together as generic refrigeration condensing and compress unit 300. Supply lines 140 are sometimes shown to circulate Freon or other coolant fluid to and from the generic refrigeration condensing and compressor unit 300 and the pan chiller assembly 100. A Turbo Coil System or other cooling system 200 may draw glycol from the first cooling area to cool a second cooling area Recirculating pumps 210 are used within the supply lines 215 to move glycol to the second cooling system 200 to cool a second compartment.

In one disclosed embodiment, a condensing unit chills the Freon that flows into the pan chiller 100. The condensing unit shuts down upon a command issued by a temperature thermostat reading the temperature of a food storage area.

A base assembly, not shown, comprises a base with the base having a temperature thermostat measuring the air temperature of the base area. The temperature thermostat of the base area controls a condensing unit to adjust the temperature of the Freon.

Figure 4:
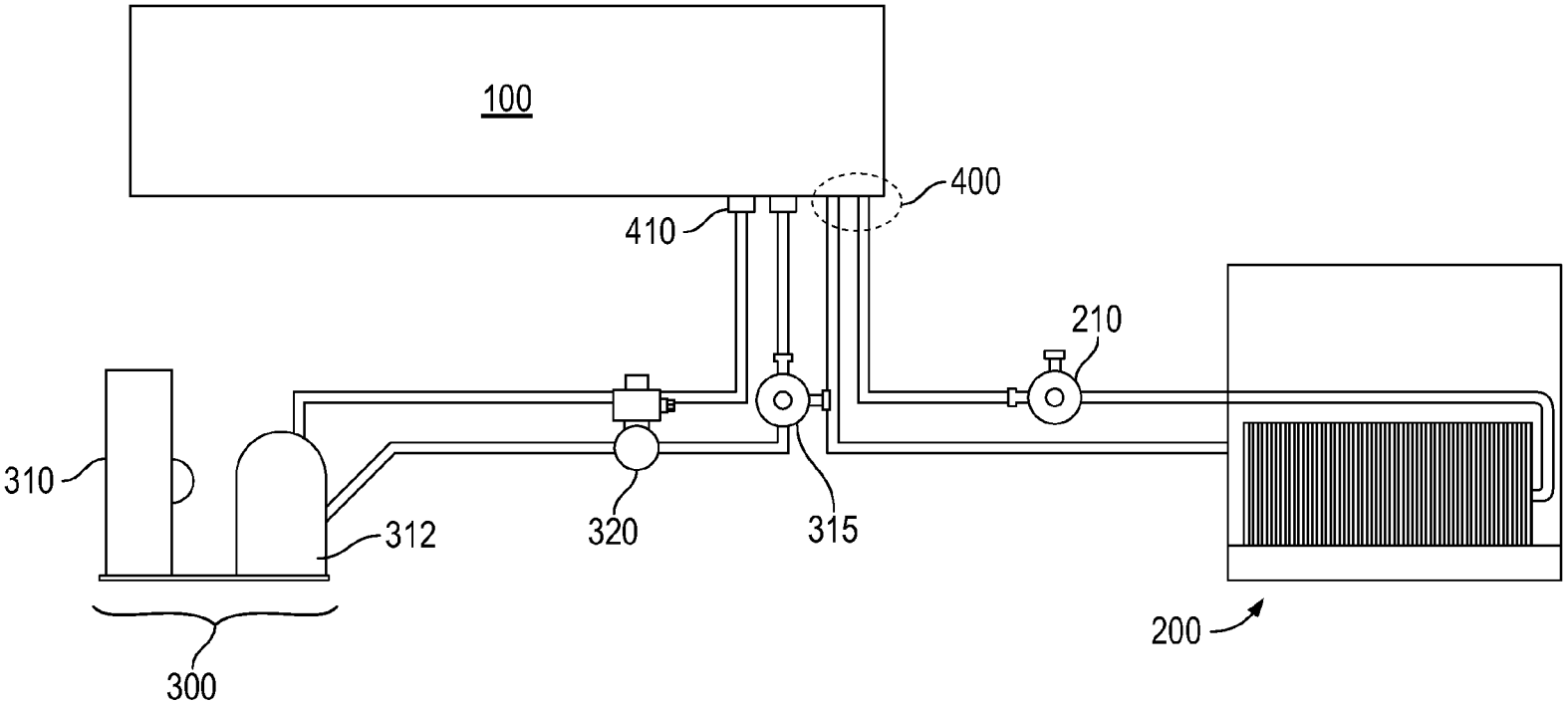
FIG. 4 depicts a disclosed cooling system

FIG. 4 depicts a self-contained preparation table embodiment comprising a pan chiller assembly 100, a unit cooler 200 to cool the Freon and a generic refrigeration condensing unit and compressor unit 300. Various valves and motors are depicted such that one reasonably skilled in the art could make and practice the disclosed embodiment. Such ancillary components include a recirculating pump 210, DX TXV 315 direct expansion thermal expansion valve and a liquid line solenoid valve and coil 320. In general, the pan chiller assembly cools by use of Freon lines surrounded by glycol and a second cooling area cools by use of glycol used in an evaporation coil system 200. In a disclosed embodiment, there is no direct cooling of the glycol as the glycol is cooled by contact with the Freon lines 140 of the pan chiller assembly 100.

Figure 5:
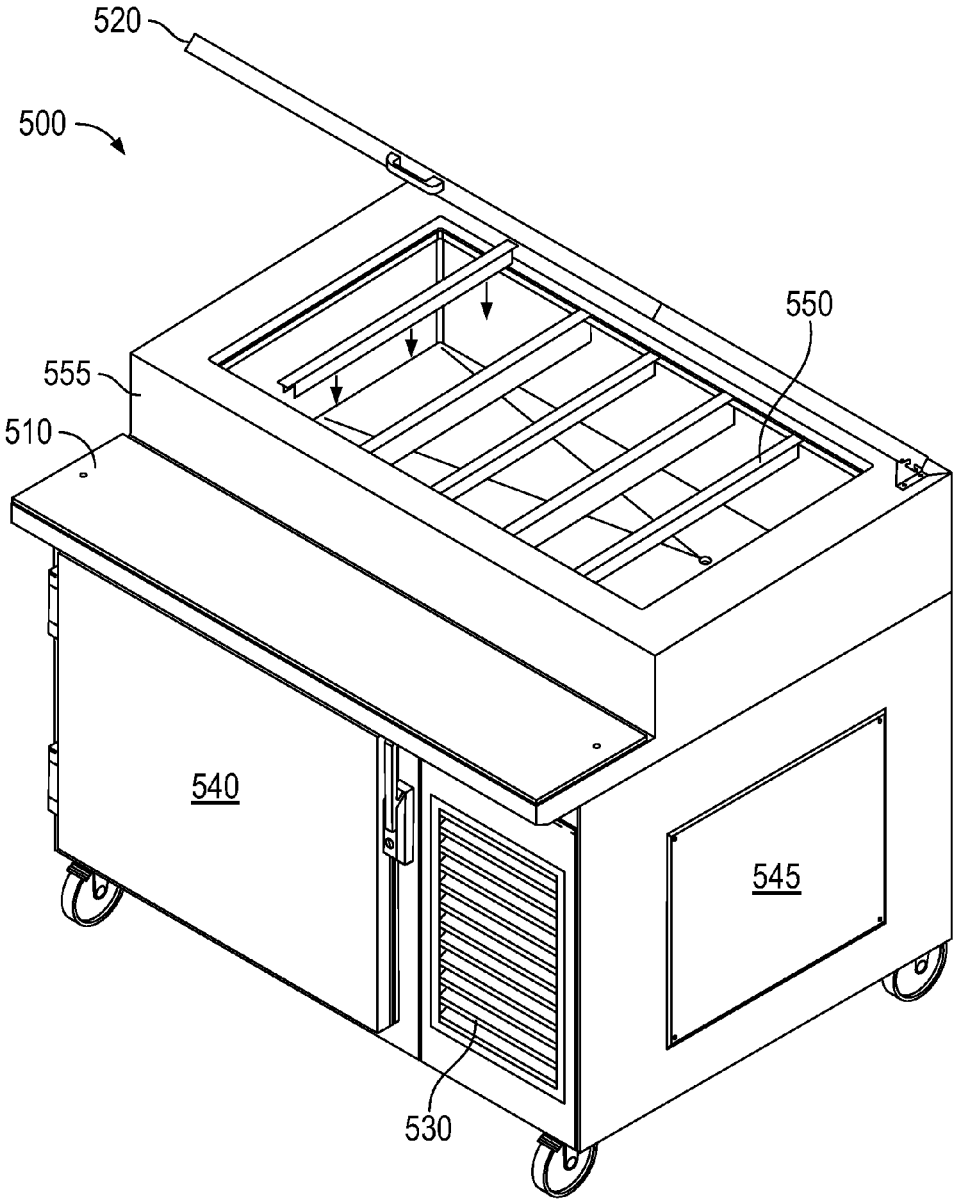
FIG. 5 depicts a perspective view of a disclosed embodiment
Figure 9:
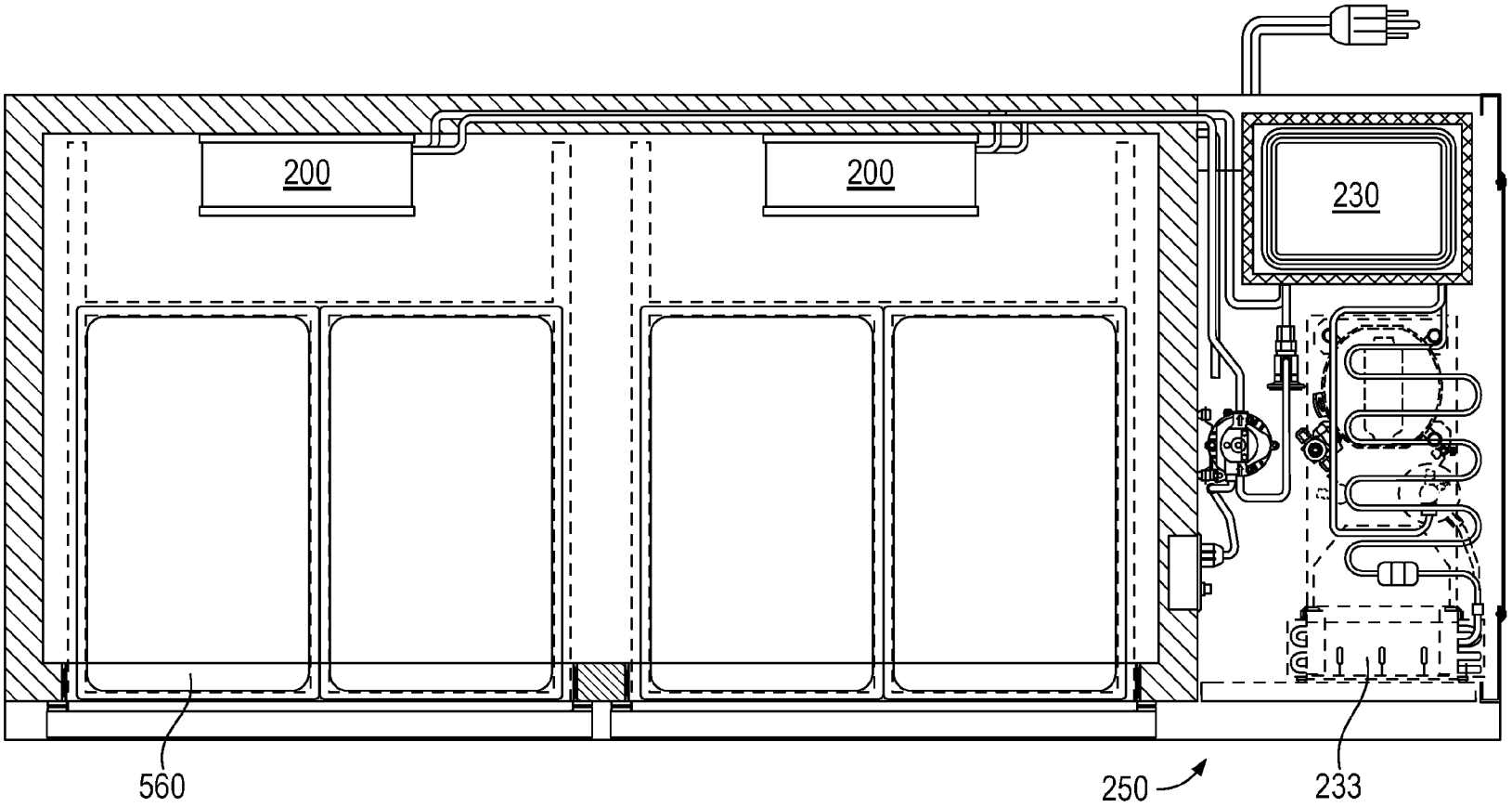
FIG. 9 depicts a disclosed embodiment

FIG. 5 depicts a disclosed housing 500 comprising a lid 520 or cover, support bars 550 sometimes used to support pans of food, a raised chamber 555, a tray shelf 510 or work shelf, a refrigeration door 540, a service panel and a vent door 530. The vent door may open to a compressor and condensation compartment 250 as shown in FIG. 9.

Figure 6:
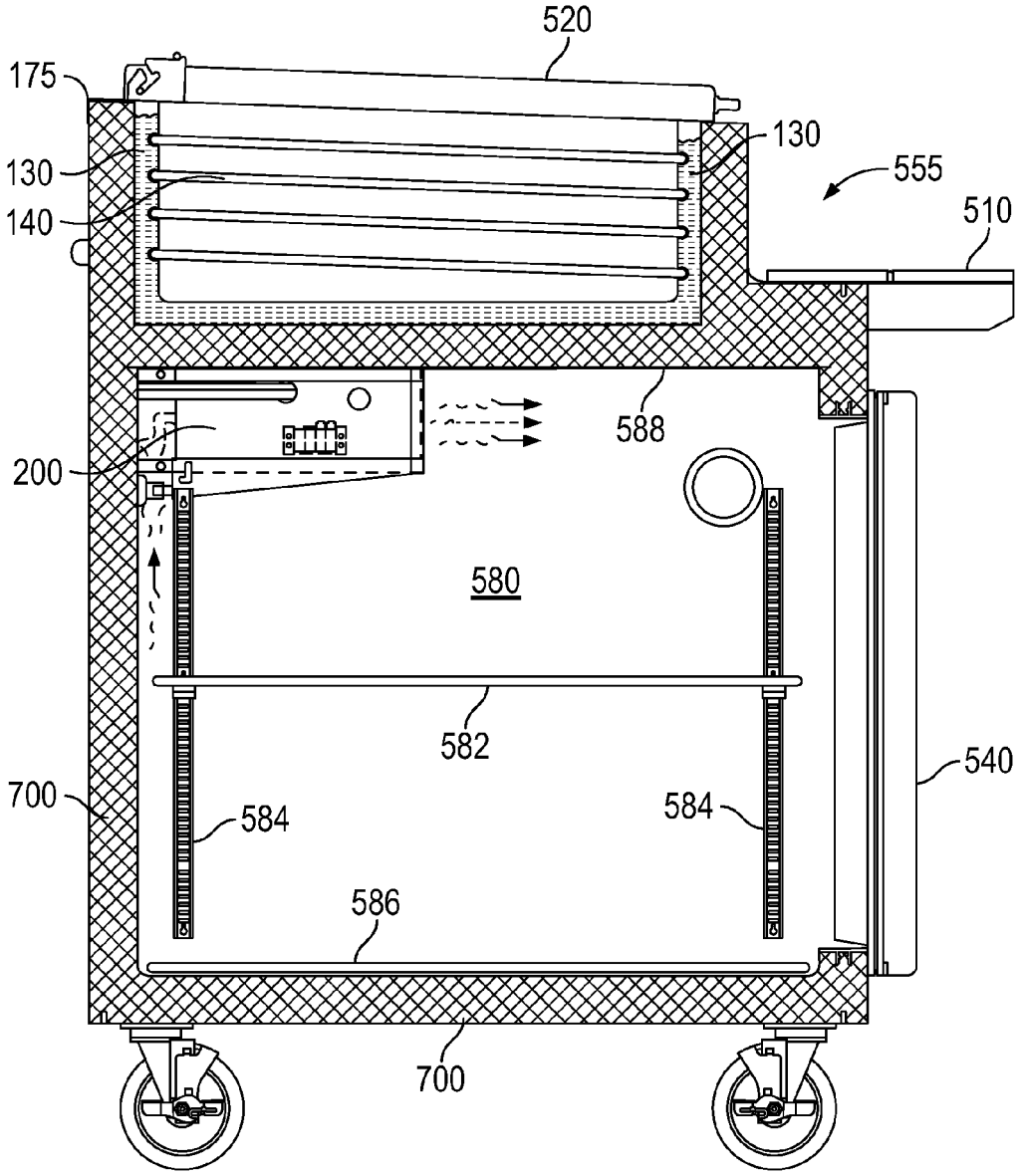
FIG. 6 depicts a side sectional view of a disclosed embodiment

FIG. 6 depicts a section and elevation view of a disclosed configuration comprising lower insulation 700, a refrigeration door 540, and interior compartment 580 a pair of interior shelf support 584 structures, an interior shelf 582 and a cooling component 200 which may use glycol. Toward the top, a tray shelf 510 is adjacent to a raised chamber 555, the raised chamber including an insulation liner 175, a void area 130 or Glycol void area 130 defined within a liner; a Freon flow line 140 is disposed within the Glycol void area 130 and cools glycol contained within the glycol void area 130. Interior compartment 580 may be considered a second cooling area and may be cooled by use of a Turbo Coil system or other evaporation coil and fan system 200.

The disclosed configuration of a first cooling area 100 and a second cooling area 580 presents unexpected results in cooling efficiencies and food preparation. As the glycol is not directly cooled with separate machinery, mechanical advantage is obtained. The glycol may be cooled by the Freon lines only and the glycol stays at a stable temperature by circulation within the first cooling area. The disclosed configuration overcomes problems in the prior art wherein each cooling area would use a separate mechanical cooling system for each line of cooled fluid.

The disclosed configuration provides greater cooling volume in the lower cooling area 580, as there is no separate refrigeration condensing and compressor unit to cool the glycol, with glycol being used to cool the second or lower cooling area 580.

Figure 7:
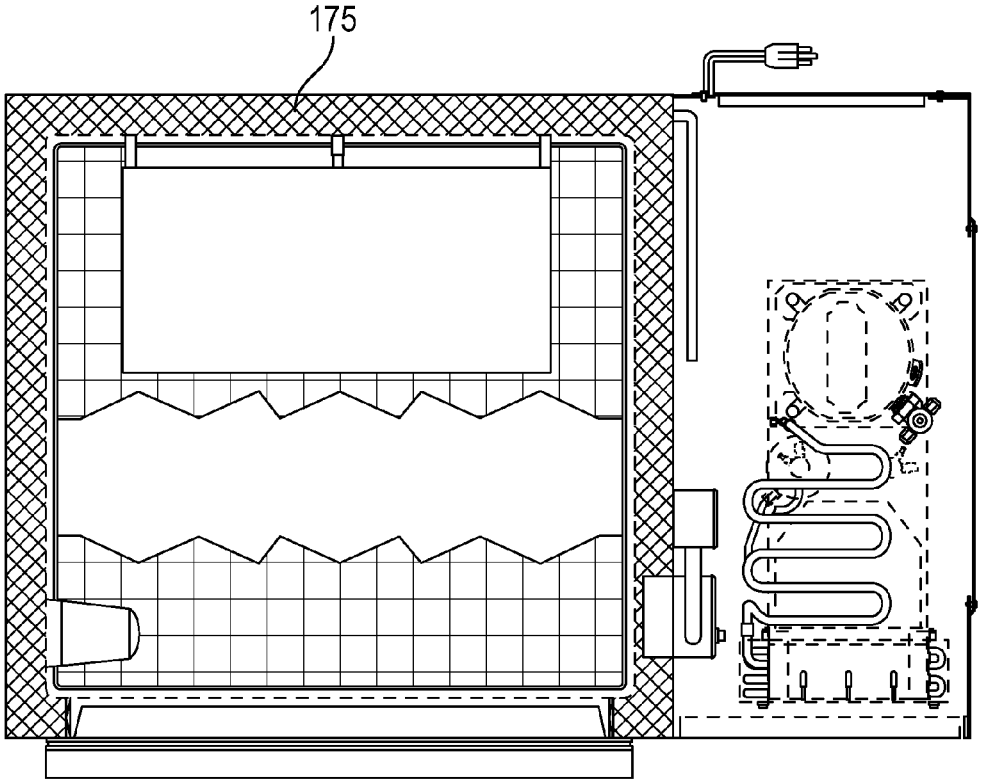
FIG. 7 depicts a sectional view of a disclosed embodiment

FIG. 7 depicts a plan view of a disclosed embodiment and depicts insulation liner components 175.

Figure 8:
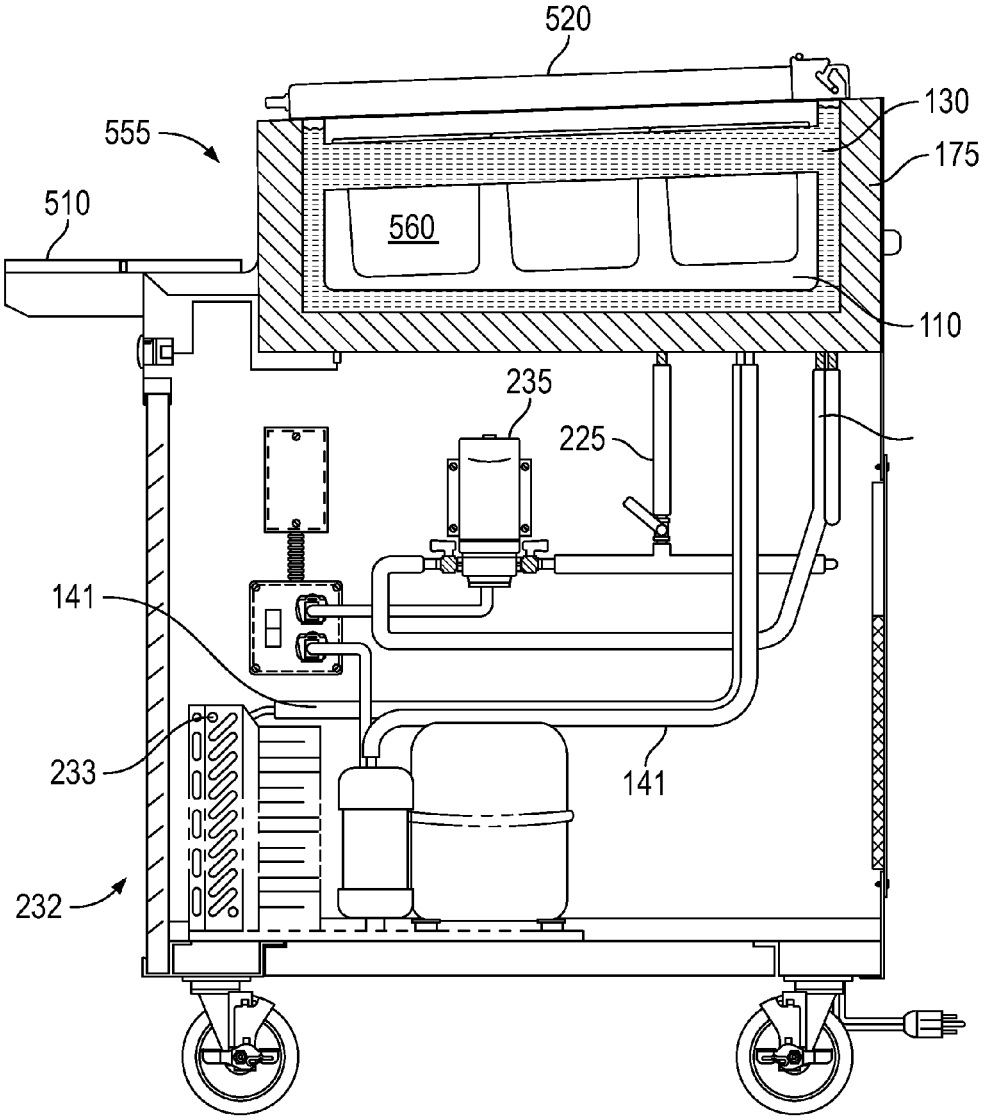
FIG. 8 depicts a side sectional view of a disclosed embodiment

FIG. 8 depicts a side sectional view of a disclosed embodiment comprising a lid 520, a Glycol void area 130, insulation liner 175, a plurality of food storage pans 560, a raised chamber 555 and a tray shelf 510. Also shown are a plurality of Glycol flow lines 225, and a Glycol pump 235. For the Freon system, a direction of air flow 232 directs ambient air into a filter 233, general Freon flow lines 141 and other components. The plurality of food pans 560 may sit within a cooling void area 110 defined by the most inner walls of the inner liner. The artful combination of the cooling void area 110, lid 520 adjacent to the top openings of the food pans, and glycol void area 130 provide advantages over the prior art. The disclosed lid system does not blow air over the contents of the food storage pans 560. The food storage pans may be considered part of the first or upper cooling area. In food preparation configurations, air blown cooling is not desirable in upper cooling areas that store food in a ready to serve condition, often unwrapped. In contrast, the lower food storage area served by the evaporation coil and fan system 200 may comprise stored food held within containers or wrapping. Thus, the passively cooled first cooling area and air blown second cooling area present a unique and useful combination of cooling components.

FIG. 9 depicts a top plan view of a disclosed embodiment comprising a plurality of food storage pans and a new glycol tank system 230. The glycol tank 230 may be filled with glycol and cooled by contact with pipe lines filled with cooled Freon. The cooled glycol within the glycol tank 230 may be circulated, as needed, within the glycol void area of the liner, as shown in FIG. 1. New efficiencies are achieved by using the existing Freon cooling system and Freon lines to continuous cool the glycol stored within the glycol tank. Thus, cooled glycol is always on hand to quickly provide additional cooling to the pan chiller system as needed and to the lower food storage area.

Figure 10:
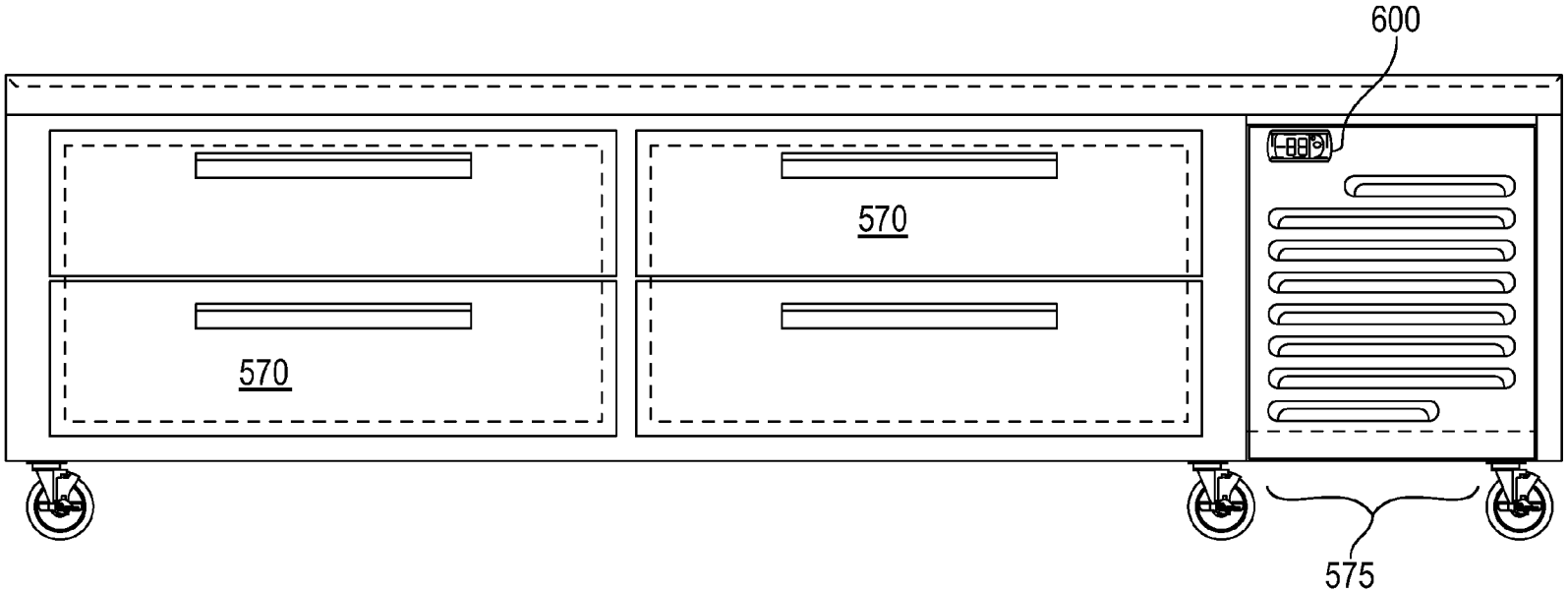
FIG. 10 depicts an elevation view of a disclosed embodiment
Figure 11:
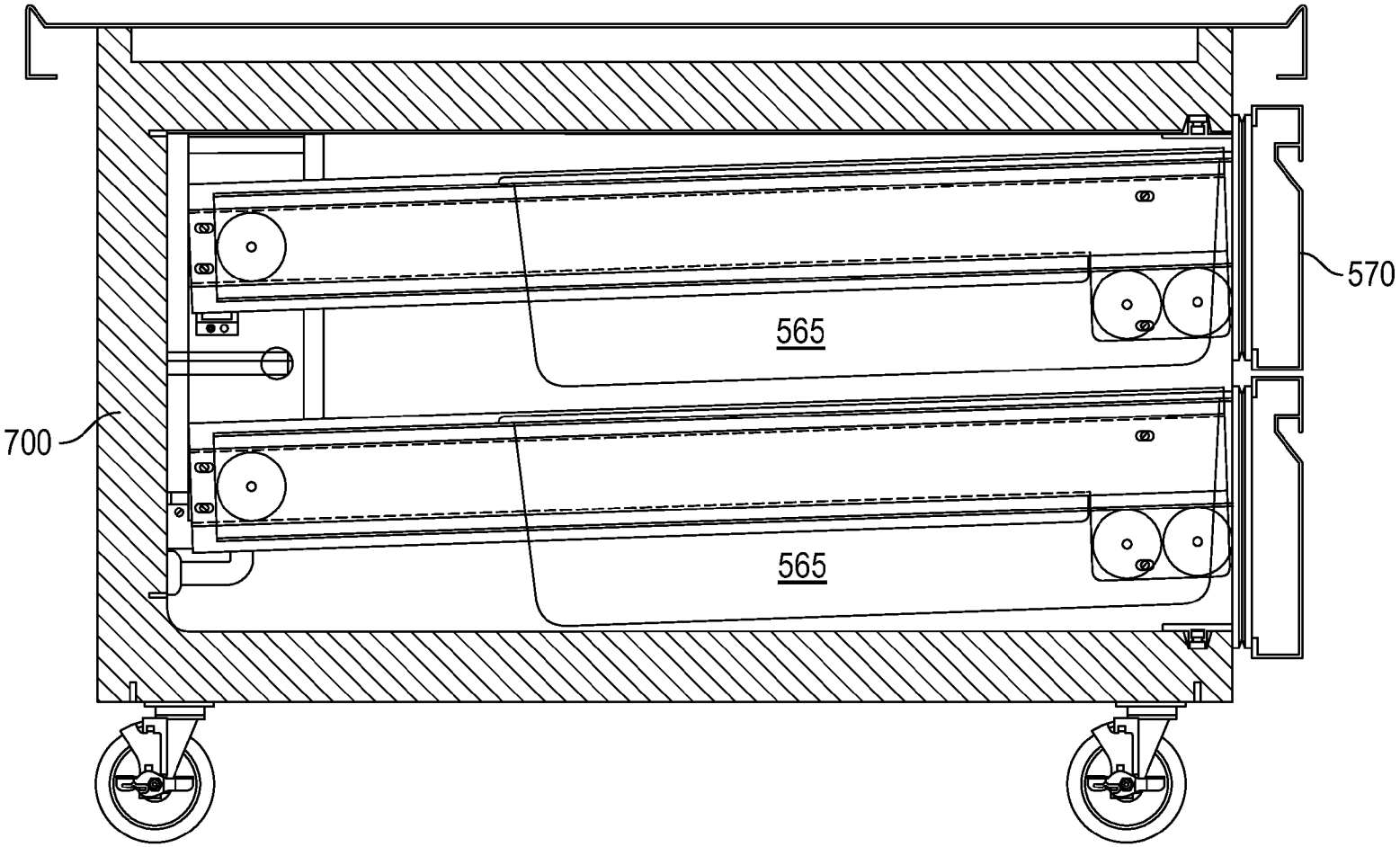
FIG. 11 depicts a sectional view of a disclosed embodiment

FIG. 10 depicts an elevation view of a disclosed embodiment including a plurality of external drawer covers 570 attached to drawers, the drawers shown in FIG. 11. FIG. 10 also shows the exterior section 575 optionally containing or covering a compartment for cooling systems.

FIG. 11 depicts a side section view of an optional drawer assembly comprising a plurality of drawers 560 attached to a door movement system or door roller system. A lower insulation system 700 is shown in attachment to the void area containing the drawers 560.

Figure 12:
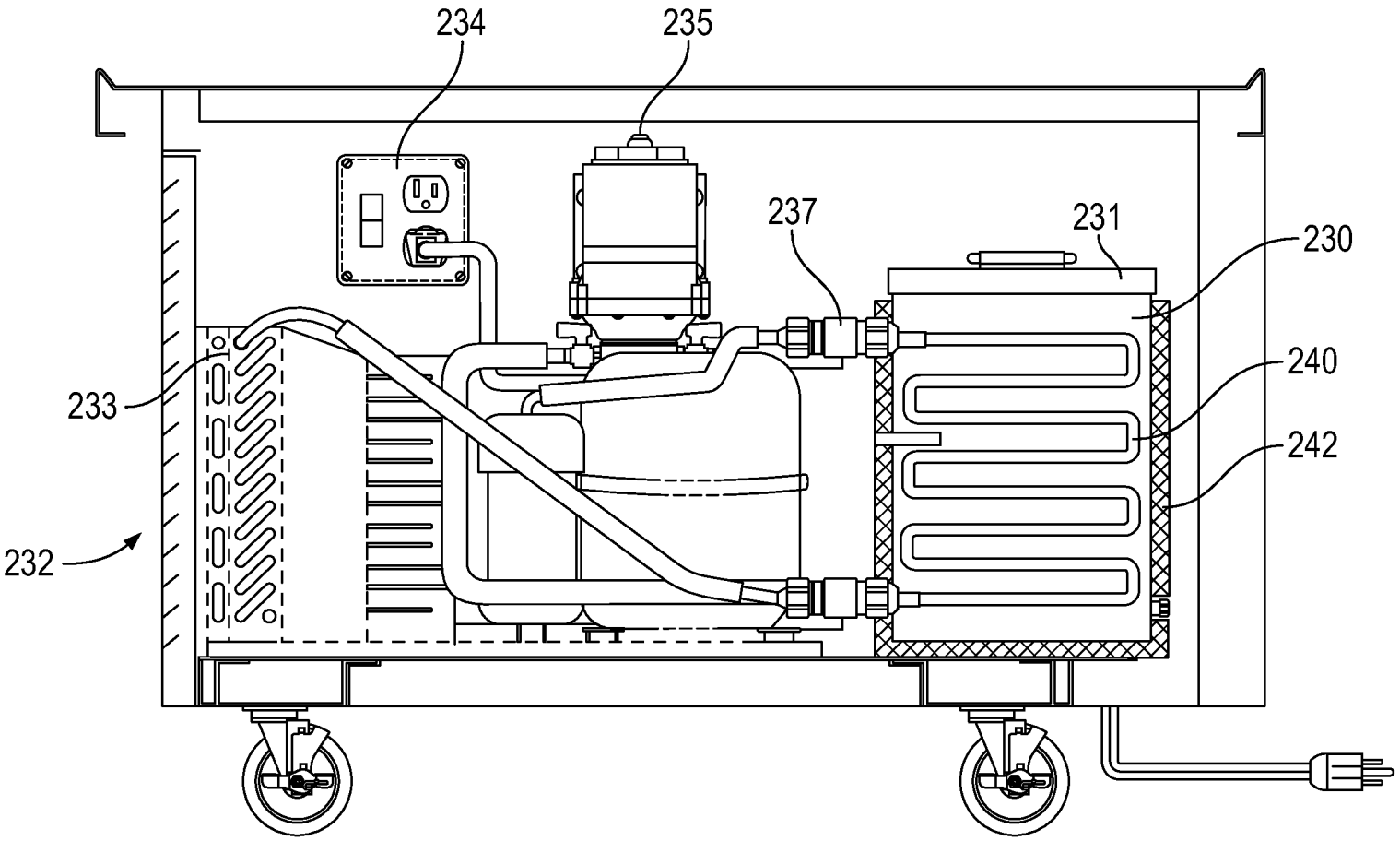
FIG. 12 depicts a sectional view of a disclosed embodiment

FIG. 12 depicts a side section view of a disclosed embodiment having a glycol tank 230, filed with glycol and containing a Freon line 240. The glycol tank may be surrounded by insulation 242 and covered by a lid 231. In this embodiment the first cooling area is within the cabinet and may be on the same plane as the second cooling area defined within the walls of the cabinet.

Figure 13:
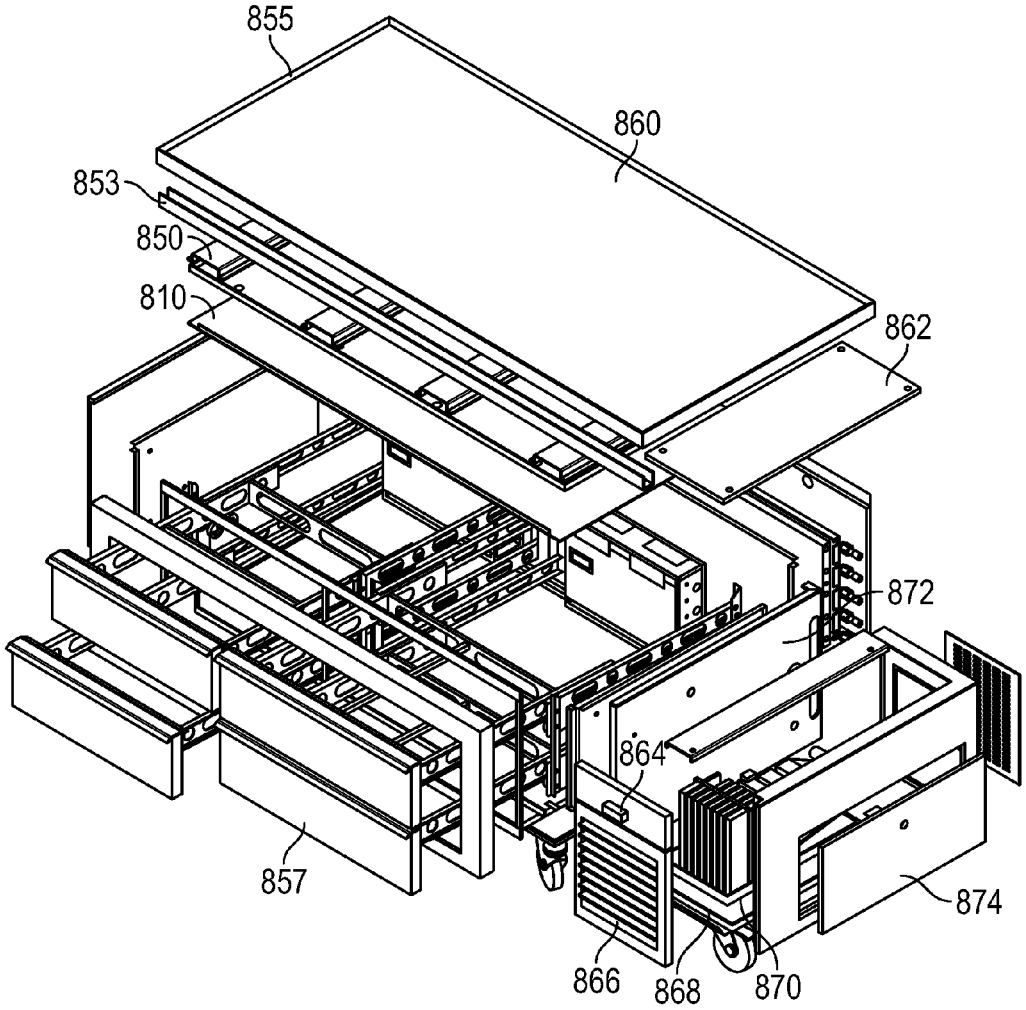
FIG. 13 depicts an exploded view of a cabinet section

FIG. 13 depicts an exploded view of a cabinet section used for a fire and ice embodiment or a cooler and burner embodiment. Disclosed components include a surface 860 for burners or a burner assembly, an exterior bottom 862, a digital thermometer 864, a louver panel, a platform 868, a pan divider front 870, exterior side 872 and exterior side cover 874. A liner top 810 is below a plurality of exterior channel supports 850. An exterior top front filler 853 may be fastened in front of the top surface 860. Drawers may have a drawer face 857.

Figure 14:
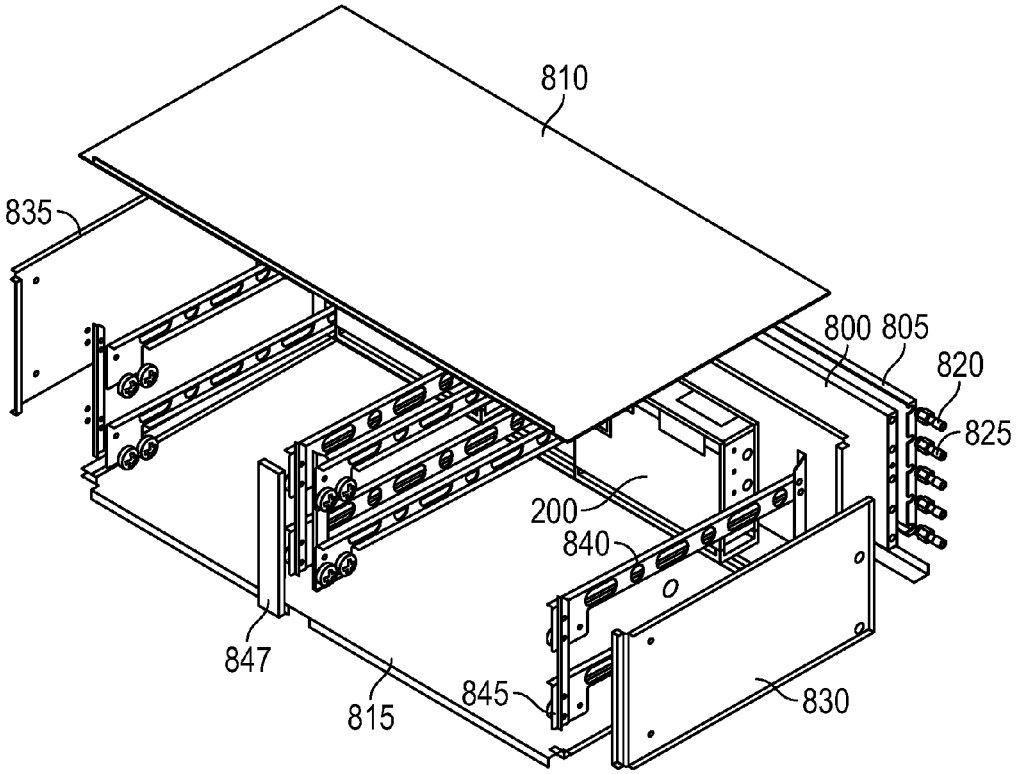
FIG. 14 depicts an exploded view of a cabinet frame

FIG. 14 depicts a cabinet frame which may comprise a liner top 810, an inside glycol tank 800, an outside glycol tank 805, a liner bottom 815, a plurality of socket weld tube fittings 820, a plurality of male to male pipe extensions, a liner side right 830, a liner side left, a plurality of drawer tracks 840, a plurality of track mounts 845 and a liner mullion 847.

Figure 15:
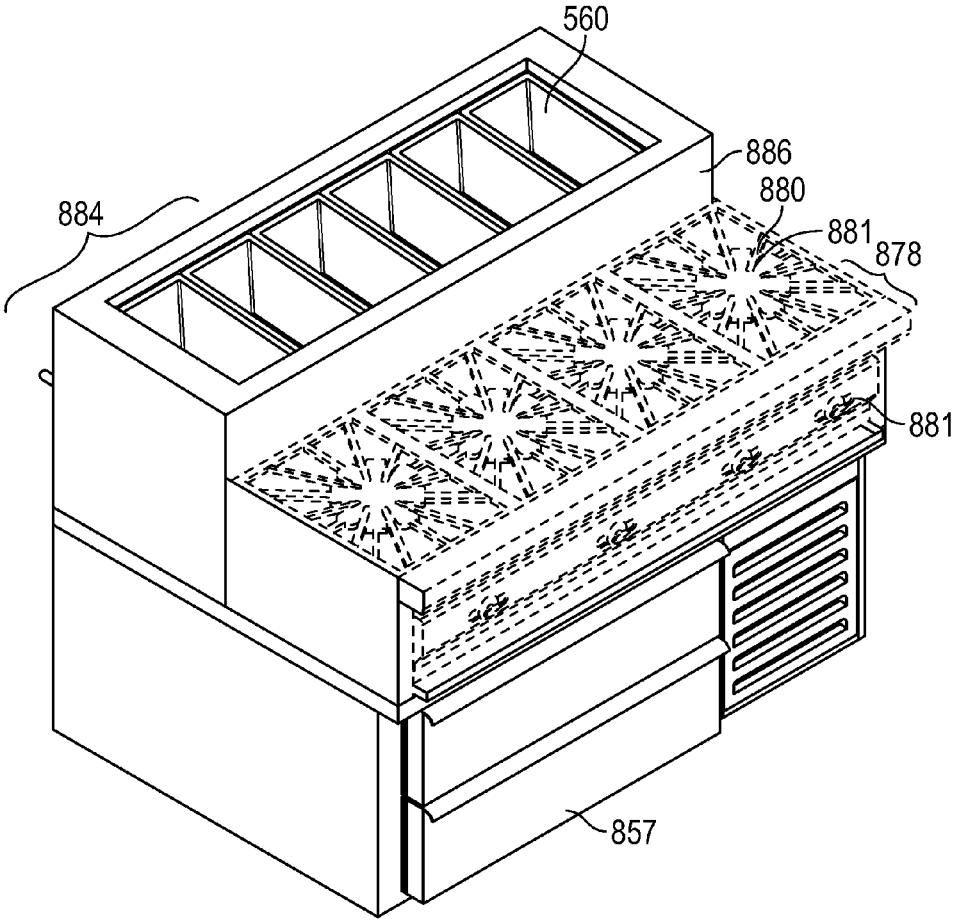
FIG. 15 depicts a front perspective view of a fire and ice or cooler and burner embodiment

FIG. 15 depicts a fire and ice embodiment having a burner assembly 878 comprising a plurality of burners 880 covered by burner grates 882. The flame of the burners 880 may be controlled by the control knobs 881.

A raised lip section 886 separates the burner assembly from the elevated cooling assembly. This configuration allows for convenient cooking and convenient access to cooled food products.

Figure 16:
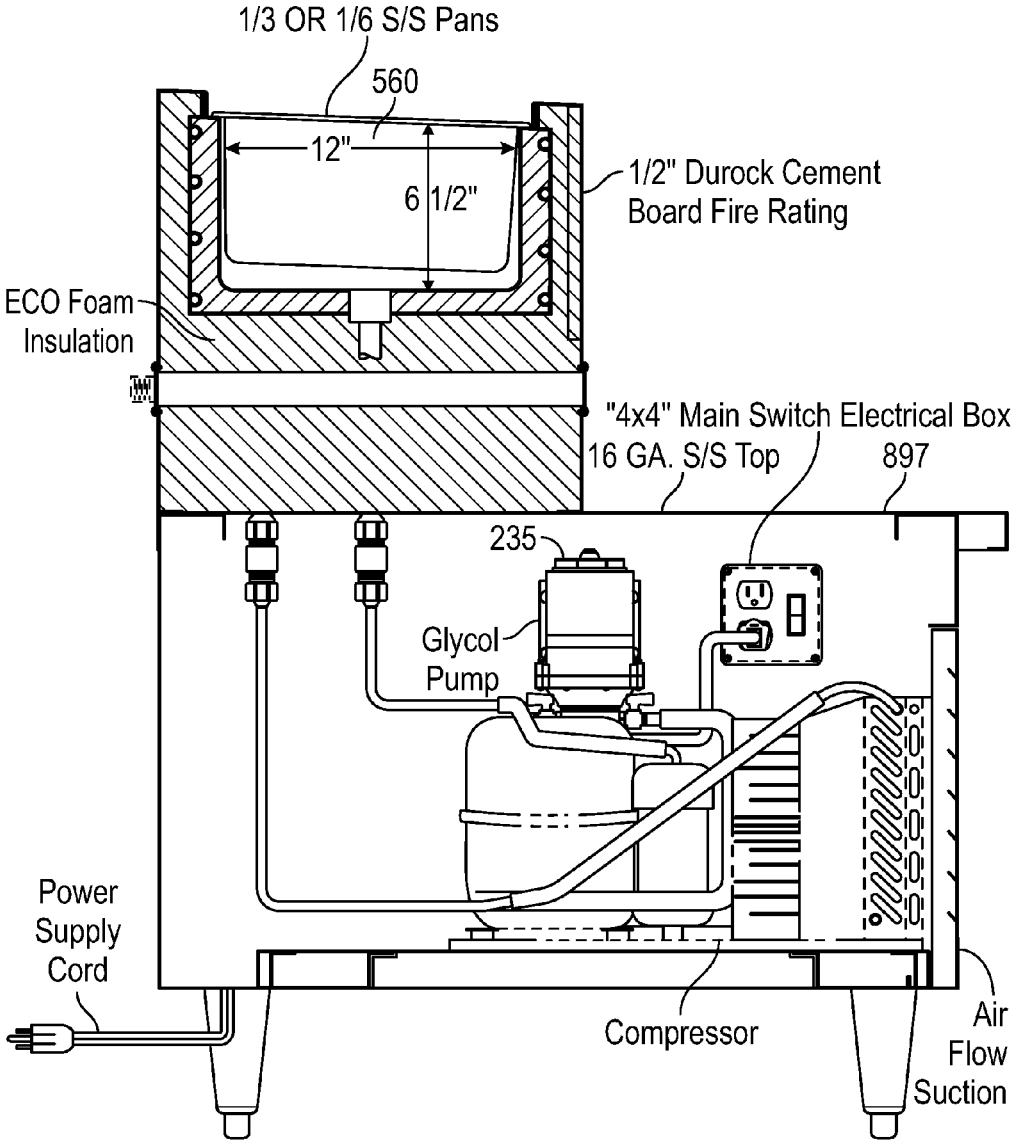
FIG. 16 depicts a side sectional view of a cooler and burner embodiment without a burner assembly

FIG. 16 depicts a side sectional view of a fire and ice embodiment devoid of the burner assembly. The front flat surface 897 may be used to support the burner assembly, the burner assembly not shown.

Figure 17:
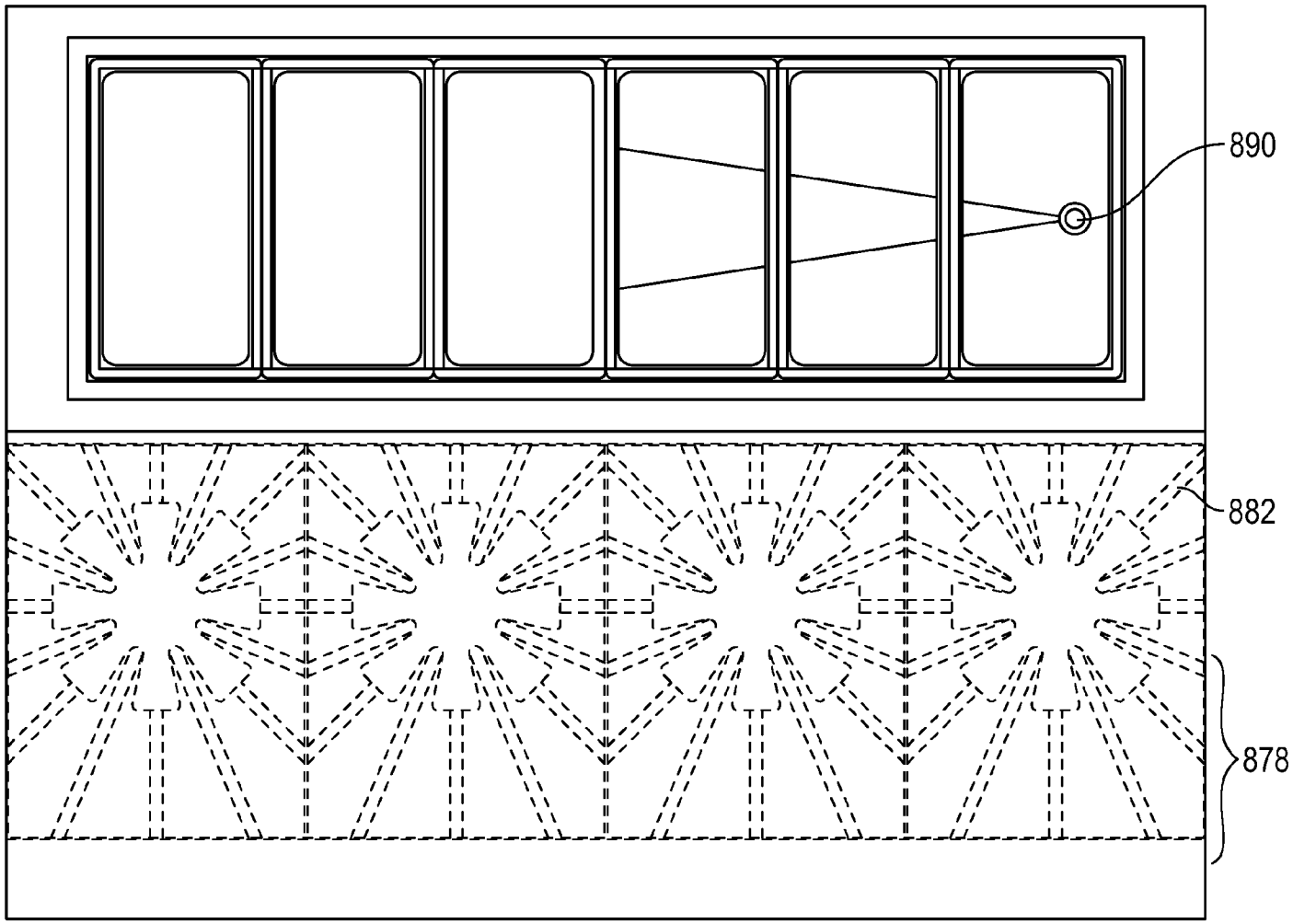
FIG. 17 depicts a top plan view of a cooler and burner embodiment

FIG. 17 depicts a top plan view of a fire and ice embodiment having a burner assembly 878, burner grates 882 and a cooling area optionally equipped with an interior drain 890.

Figure 18:
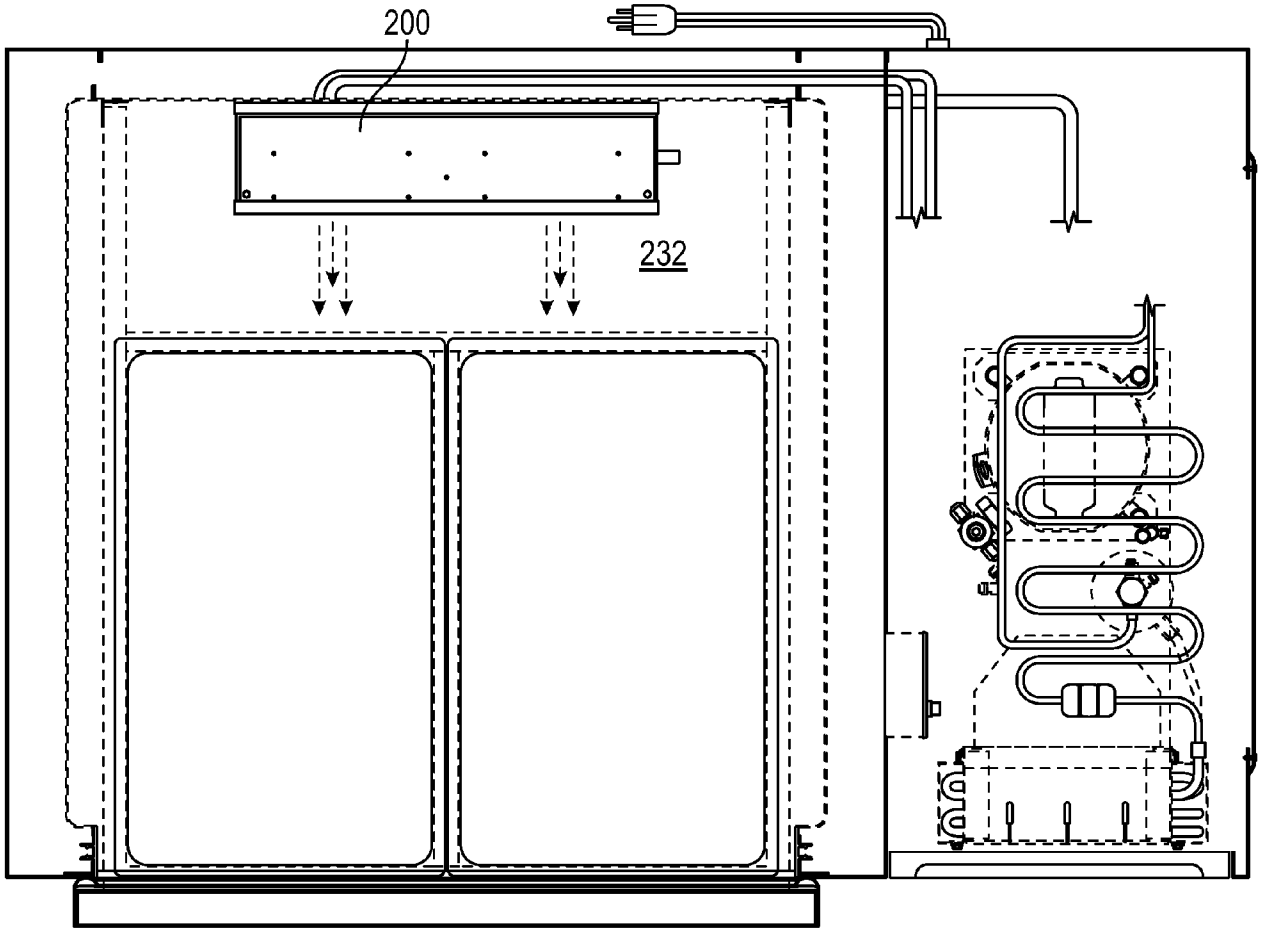
FIG. 18 depicts a top sectional view of a cooler and burner embodiment

FIG. 18 depicts a sectional view showing a turbo coil or cooling system 200 blowing cold air along directional arrows 232 to a cooling chamber.

Figure 19:
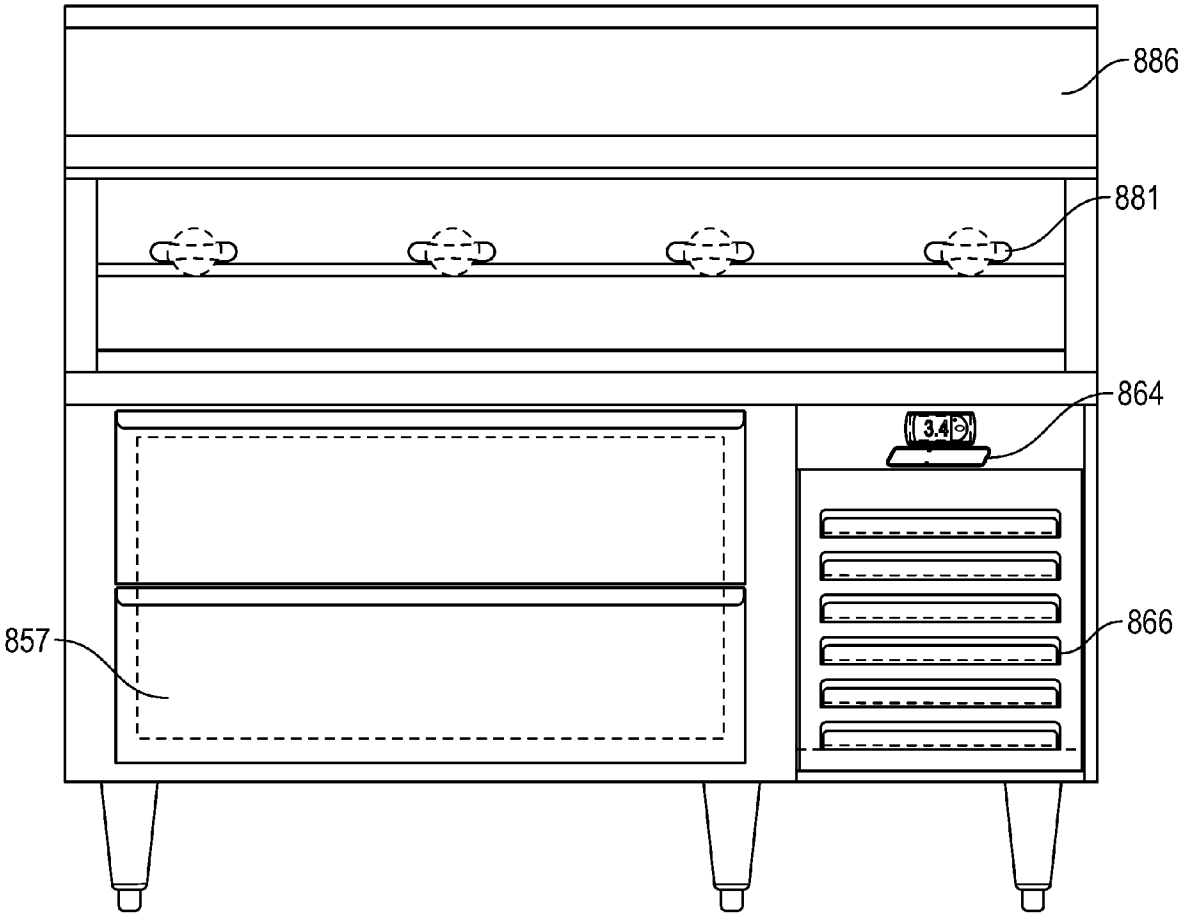
FIG. 19 depicts a front elevation view of a cooler and burner embodiment

FIG. 19 depicts a front elevation view of a fire and ice embodiment featuring drawer covers 857, gas control knobs 881, a louver panel 866 and a digital thermometer 864. The raised lip section 886 is shown in the background while the burner knobs are shown in the foreground.

Figure 20:
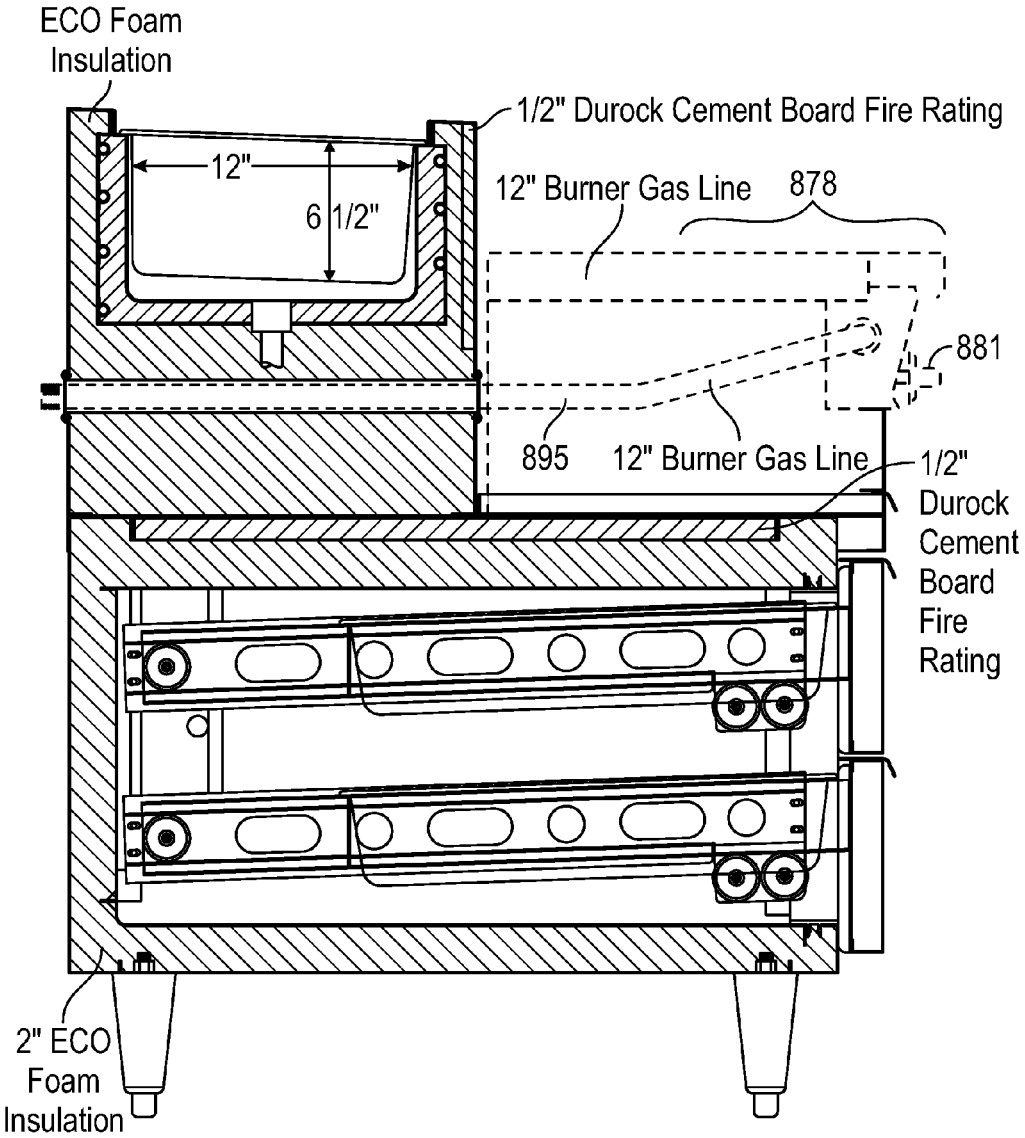
FIG. 20 depicts a side section view of a cooler and burner embodiment

FIG. 20 depicts a side section view of a fire and ice embodiment. A gas line 895 is shown connected to the burner assembly 878 which includes gas control knobs 881.

Figure 21:
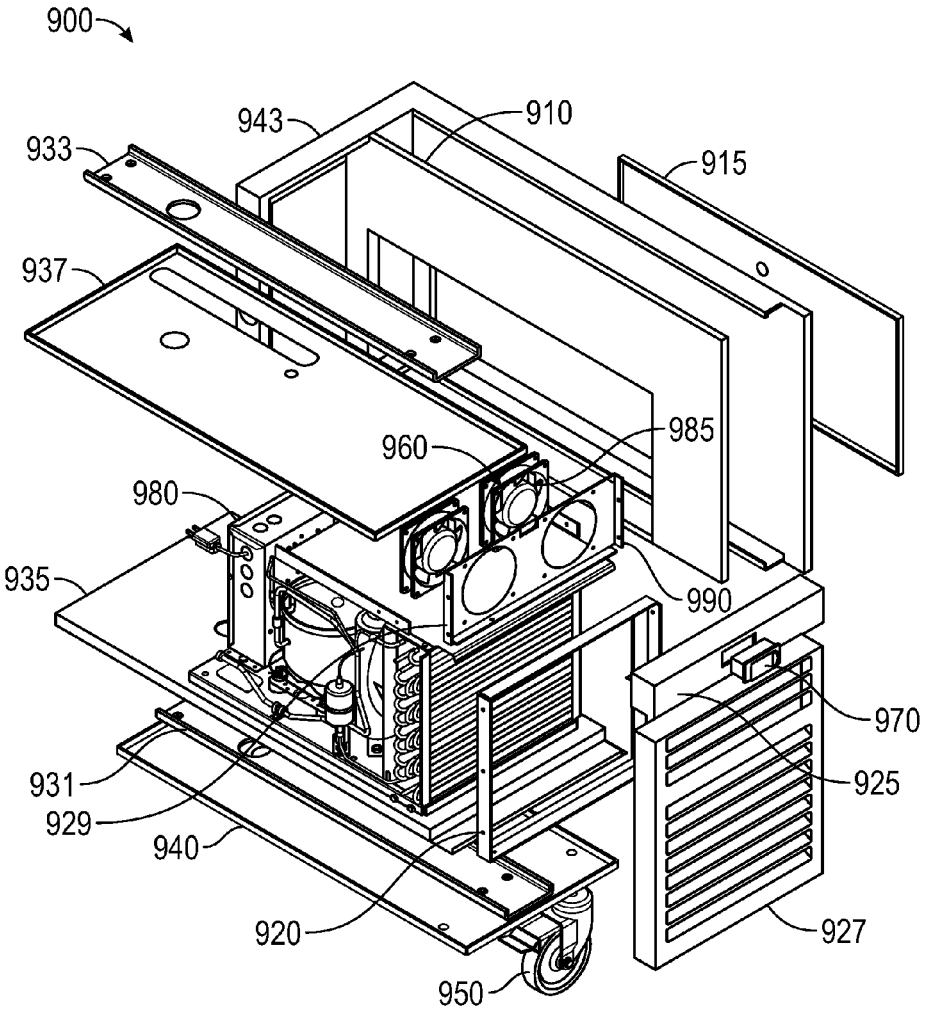
FIG. 21 depicts a perspective view of a compressor and cabinet configuration

FIG. 21 depicts a compressor system 900 and cabinet configuration that includes a fan housing 990, the fan housing enclosing an upper section of the compressor which creates a vacuum system or area to draw hot air out of the compressor compartment.

Items

Disclosed embodiments include the following items.

Item 1. A food cooling system, the system comprising:

a) an inner liner 160, defining a first food cooling area, the inner liner comprising an outer wall 150 connected to an inner wall 120, the inner wall and outer wall defining a glycol void area 130, and an inside area of the inner wall defining a cooling area 110;

b) a Freon flow line 140 disposed within the glycol void area;

c) glycol disposed within the glycol void area, the glycol in contact with the Freon flow line;

d) the Freon flow line containing circulating Freon, the Freon cooled by use a compressor, condenser and evaporation coil;

e) the glycol within the glycol void area cooled by contact with the Freon flow line;

f) the glycol disposed within the glycol void area, the glycol void area connected to a pipe line leading to a evaporation coil and fan system 200 disposed within a second food cooling area 580.

Item 2. The system of item 1 further comprising a removable layer of insulation 175 in contact with the outer wall 150 of the inner liner 160;

Item 3. The system of item 1 further comprising a plurality of food pans 560 disposed within the cooling area 110 and a lid 520 attached with a hinge to a preparation table assembly 500, the lid, in a closed position preventing cooled air from reaching the food pans 560.

Item 4. The system of item 3 further comprising a tray shelf 510 attached to the preparation table assembly, and the tray shelf attached to a raised chamber 555, the raised chamber containing the inner liner and glycol void area 130, the raised chamber further containing a plurality of support bars.

Item 5. The system of item 4 wherein the preparation table assembly 500 further comprising a lower interior compartment 580 defined by a door 530, a floor 586, a back wall 587 and a ceiling 588, the back wall attached to an evaporation coil system 200.

Item 6. A method of cooling food, the method comprising:

a) using a first food cooling area defined within an inner liner 160, the inner liner comprising an outer wall connected to an inner wall, the inner wall and outer wall defining a glycol void area 130, and an inside area of the internal wall defining a cooling area 110;

b) using a Freon flow line 140 disposed within the glycol void area;

c) using glycol disposed within the glycol void area, the glycol in contact with the Freon flow line;

d) using the Freon flow line containing circulating Freon, the Freon cooled by use a compressor, condenser and evaporation coil;

e) using the glycol within the glycol void area cooled by contact with the Freon flow line;

using the glycol disposed within the glycol void area having a pipe line to a second cooling area 580 and using glycol to cool the second cooling area by use of evaporation coil and fan system to blow cool air within the second cooling area.

Item 7. The method of item 6 further using a removable layer of insulation 175 in contact with the outer wall 150 of the inner liner 160;

Item 8. The method of item 6 further using a plurality of food pans 560 disposed within the cooling area 110 and a lid 520 attached with a hinge to a preparation table assembly 500, the lid, in a closed position preventing cooled air from reaching the food pans 560.

Item 9. The method of item 8 further using a tray shelf 510 attached to the preparation table assembly, and the tray shelf attached to a raised chamber 555, the raised chamber containing the inner liner and glycol void area 130, the raised chamber further containing a plurality of support bars.

Item 10. The method of item 9 using the preparation table assembly 500 further comprising a lower interior compartment 580 defined by a door 530, a floor 586, a back wall 587 and a ceiling 588, the back wall attached to an evaporation coil system 200.

What is claimed is:

1. A two compartment food cooling system, the system comprising:

a) an inner liner, the inner liner comprising an outer wall connected to an inner wall, the inner wall and outer wall defining a glycol void area, and an inside area of the inner wall defining a first food cooling area;

b) a refrigerant flow line disposed within the glycol void area;

c) glycol disposed within the glycol void area, the glycol in contact with the refrigerant flow line;

d) the refrigerant flow line containing circulating refrigerant, the refrigerant cooled by the use of a compressor, condenser, and evaporation coil.

e) the glycol within the glycol void area cooled by contact with the refrigerant flow line;

f) the glycol disposed within the glycol void area connected to a pipe line, the pipe line connected to a glycol tank, the glycol tank disposed within a second food cooling area, the glycol tank comprising glycol and a second refrigerant flow line, the second refrigerant flow line in direct contact with the glycol within the glycol tank; the evaporation coil and fan system disposed within a second food cooling area;

g) a thermostat and control valve measuring the temperature within the first food cooling area, and connected to a glycol pump, the thermostat and control valve activating the glycol pump upon the first food cooling area exceeding a predetermined temperature.

2. The system of claim 1 further comprising a removable layer of insulation in contact with the outer wall of the inner liner and wherein the second food cooling area is defined within a cabinet disposed below the first food cooling area.

3. The system of claim 1 further comprising a plurality of food pans disposed within the first food cooling area and a lid attached with a hinge to a preparation table assembly, the lid, in a closed position preventing cooled air from reaching the food pans.

4. The system of claim 3 further comprising a tray shelf attached to the preparation table assembly, and the tray shelf attached to a raised chamber, the raised chamber containing the inner liner and glycol void area, the raised chamber further containing a plurality of support bars.

5. The system of claim 4 wherein the preparation table assembly further comprising a lower interior compartment defined by a door, a floor, a back wall and a ceiling, the back wall attached to the evaporation coil.

6. A method of cooling food, within a two compartment cooling system, the method comprising:

a) using an inner liner, the inner liner comprising an outer wall connected to an inner wall, the inner wall and outer wall defining a glycol void area, and an inside area of the internal wall defining a first food cooling area;

b) using a refrigerant flow line disposed within the glycol void area;

c) using glycol disposed within the glycol void area, the glycol in contact with the refrigerant flow line;

d) using the refrigerant flow line containing circulating refrigerant, the refrigerant cooled by use of a compressor, condenser and evaporation coil;

e) using the glycol disposed within the glycol void area connected to a pipe line, the pipe line connected to a glycol tank, the glycol tank disposed within a second food cooling area, the glycol tank comprising glycol and a second refrigerant flow line, the second refrigerant flow line in direct contact with the glycol within the glycol tank;

f) using the evaporation coil and fan system disposed within a second food cooling area;

g) using the glycol within the glycol void area to cool the second food cooling area by the use of the evaporation coil and fan system used to blow air within the second food cooling area; and h) using a thermostat and control valve for measuring the temperature within the first food cooling area, and connected to a glycol pump, the thermostat and control valve activating the glycol pump upon the first food cooling area exceeding a predetermined temperature.

7. The method of claim 6 further using a removable layer of insulation in contact with the outer wall of the inner liner.

8. The method of claim 7 further using a plurality of food pans disposed within the first food cooling area and a lid attached with a hinge to a preparation table assembly, the lid, in a closed position preventing cooled air from reaching the food pans.

9. The method of claim 8 further using a tray shelf attached to the preparation table assembly, and the tray shelf attached to a raised chamber, the raised chamber containing the inner liner and glycol void area, the raised chamber further containing a plurality of support bars.

10. The method of claim 9 using the preparation table assembly further comprising a lower interior compartment defined by a door, a floor, a back wall and a ceiling, the back wall attached to the evaporation coil.

* * * * *